United States Patent [19]

Brower, Jr. et al.

[11] 4,107,016

[45] Aug. 15, 1978

[54] METHOD AND APPARATUS FOR ELECTRO-PHORECTIC COATING

[75] Inventors: Loyd R. Brower, Jr., Olympia Fields; Leonard P. Madsen, St. Anne; Chesly L. Zutaut, Park Forest; Walter M. Barden, Jr., Wheaton, all of Ill.

[73] Assignee: Standard T. Chemical Company, Inc., Chicago, Ill.

[21] Appl. No.: 807,965

[22] Filed: Jun. 20, 1977

Related U.S. Application Data

[63] Continuation of Ser. No. 686,110, Jun. 7, 1976, abandoned, which is a continuation-in-part of Ser. No. 597,314, Jul. 21, 1975, abandoned.

[51] Int. Cl.[2] ..... C25D 13/14

[52] U.S. Cl. ..... 204/181 R; 204/181 C; 204/300 EC

[58] Field of Search ..... 204/181 R, 181 C, 300 EC

[56] References Cited

U.S. PATENT DOCUMENTS

| | | | |
|---|---|---|---|
| 3,922,213 | 11/1975 | Smith et al. | 204/181 R |
| 3,997,418 | 12/1976 | Buse et al. | 204/181 R |

*Primary Examiner*—Howard S. Williams

*Attorney, Agent, or Firm*—Carpenter & Ostis

[57] ABSTRACT

Method and apparatus for electrophoretically coating a surface of an electrically conductive work piece having a selected linear dimension including the steps of: establishing the work piece at one electrical potential, flowing an electrophoretic coating in a linear stream corresponding to the linear dimension and in close proximity to the work piece surface, imparting an electrical charge to the electrophoretic coating, impinging the charged linear stream of electrophoretic coating onto the work piece surface and moving the work piece and charged linear stream relative to one another and in a direction lateral to the selected linear dimension, to electrophoretically coat the entirety of such work piece surface.

17 Claims, 16 Drawing Figures

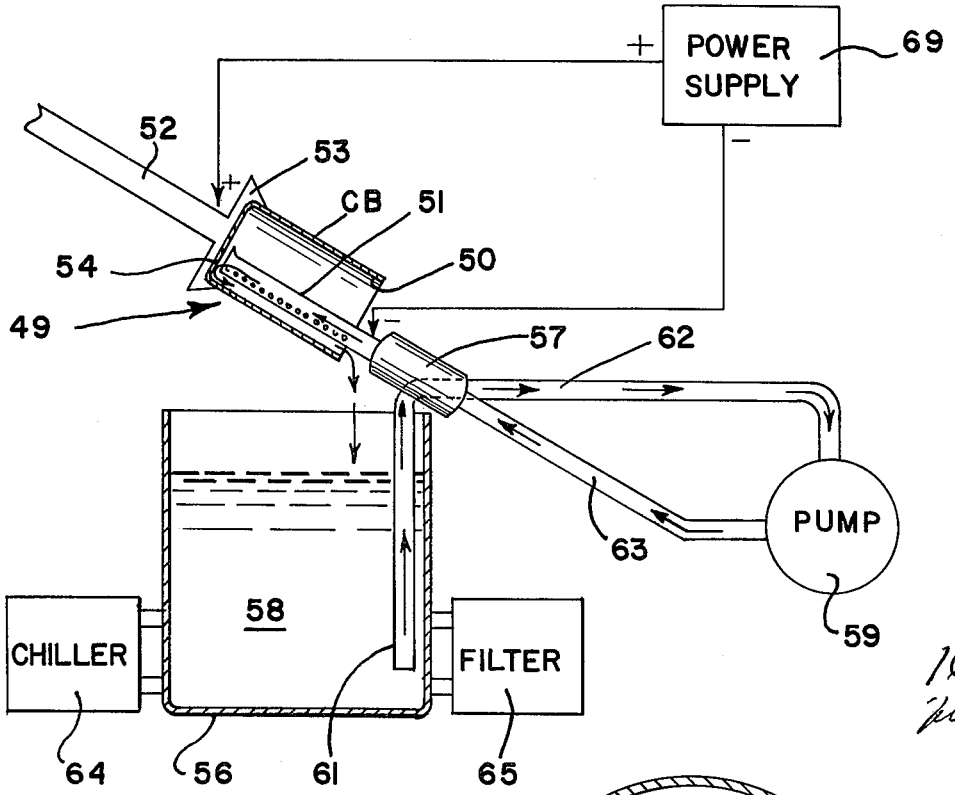
FIG. 6
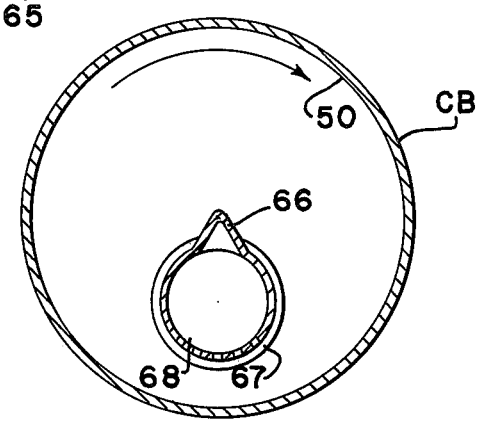
FIG. 7
FIG. 8
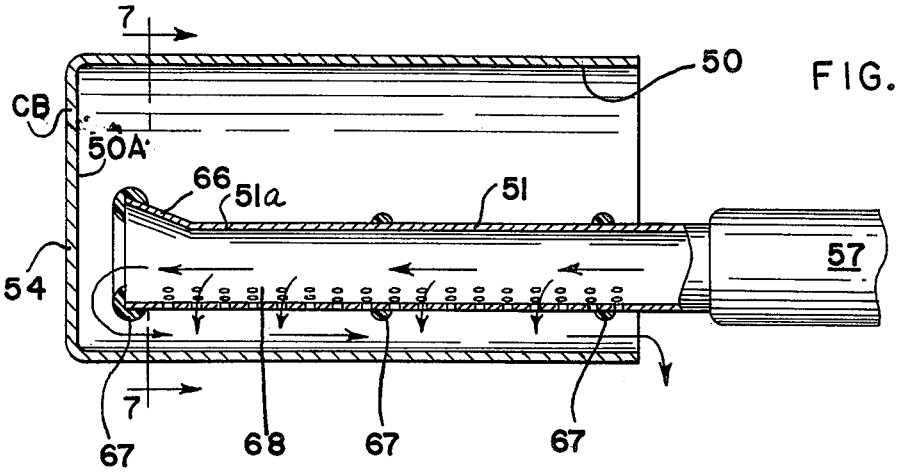

FIG. 9
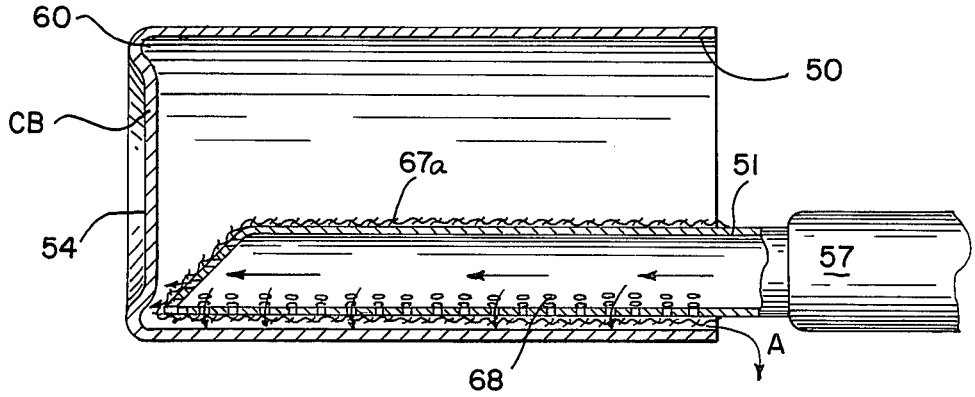
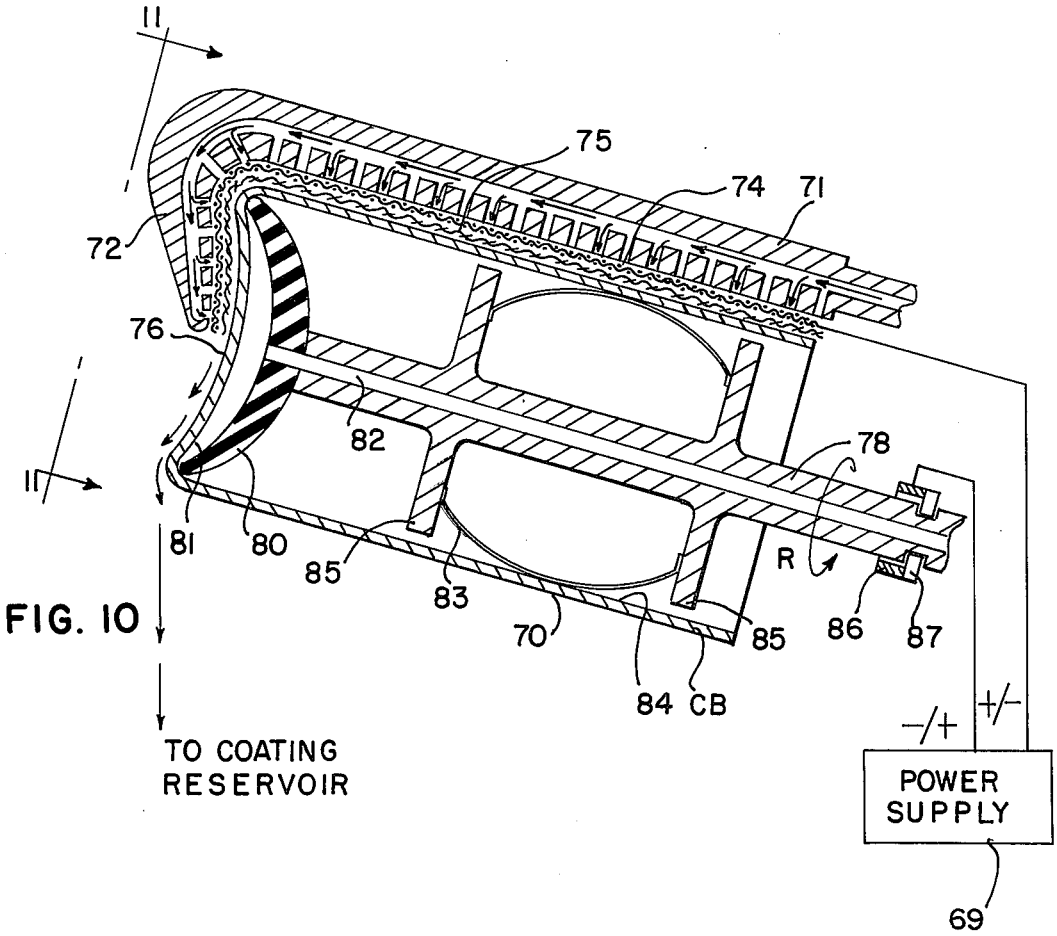
FIG. 10

METHOD AND APPARATUS FOR ELECTRO-PHORECTIC COATING

This is a continuation of application Ser. No. 686,110, filed June 7, 1976, which is a continuation-in-part of application Ser. No. 597,314, filed on July 21, 1975, and both now abandoned.

BACKGROUND OF THE INVENTION

The present invention relates generally to the coating of a work piece with an electrophoretic coating material. More particularly, the present invention concerns method and apparatus for electrophoretically coating a conductive work piece, such method comprising the steps of: establishing the work piece at one electrical potential, flowing an electrophoretic coating in a linear stream corresponding to the linear dimension and in close proximity to the work piece surface, imparting an electrical charge to the electrophoretic coating, impinging the charged linear stream of electrophoretic coating onto the work piece surface and moving the work piece and charged linear stream relative to one another and in a direction lateral to the selected linear dimension, to electrophoretically coat the entirety of such work piece surface. The present invention has particular application in the coating of internal and external surfaces of containers, such as cans, and other objects, such as heat exchangers, radiators, drums, automobile wheels, automobile oil filter caps and the like.

Electrophoresis generally concerns the movement of ionic particles within an aqueous system in response to electrical charges imparted to such system. Negatively charged particles or ions in such an aqueous solution (i.e., an anodic coating) migrate in response to such electrical potential to any positively charged conductor which may be immersed in the solution for deposit thereon. Positively charged particles or ions (i.e., cathodic coating materials) likewise migrate and are deposited upon a negatively charged conductor within the coating bath.

Typically, an electrical potential in the range of approximately 100 to 500 volts has been used for electrophoretic coating. The thickness, and hence durability, of such electrophoretically deposited coating layer is dependent upon a number of factors, including, inter alia, the voltage used, the separation between the anode and cathode, the length of time coating is permitted to continue, the pH of the coating solution, the characteristics of the coating polymer used and the conductivity of the particular material then being coated. During coating, after some coating particles have been deposited upon the conductive surface being coated, there is a gradual reduction in the conductivity thereof and the work piece being coated becomes increasingly insulated. When the thickness of the electrophoretically deposited coating layer becomes sufficiently thick for a given system, the previously conductive surface becomes insulated to the extent that no further substantial electrodeposition will occur. Similarly, if some portion of the surface of the work piece to be coated has been previously coated with an insulating coating, further electrodeposition on that coated surface will occur only with higher voltages, closer proximity of electrodes, more conductive coating materials, longer coating times or other changes to the system.

Various of the above techniques of electrophoretic coating have been used heretofore in the art. Those techniques have had a number of disadvantages associated therewith. In many such prior art electrophoretic coating techniques, it has been necessary to immerse the work piece into a coating bath, which has necessitated large capital outlays for the often spacious tanks required to accommodate the work piece therein. Also, such immersion techniques have been found to require an excessive amount of time and extra mechanical equipment to accomplish such dipping or immersion.

A further serious disadvantage of such prior art immersion techniques is the necessary result that both the internal and external surfaces of the work piece to be coated must be done simultaneously. This is especially undesirable when, as is often the case, either the exterior surface or the interior surface thereof should not or does not need to be coated, or when different types of coating are required for the interior and exterior surfaces. The waste involved and lack of product flexibility constitute in many cases debilitating disadvantages so severe that other, even more expensive, techniques may become necessary.

Another technique used heretofore has been the electrodeposition of coating materials on sheet metal prior to its being fabricated into a particular coated body. Such techniques have resulted in exposed and/or uncoated breaks in the coating, which have occurred during the various fabrication steps, such as stamping, welding, heating, etc. Such unprotected areas may be especially undesirable in the container industry, or in other industries where bare metal will constitute a safety hazard or economic loss.

Yet another prior art technique, that of electrostatic spraying, has been used for various commercial coating operations. A number of further disadvantages have also resulted from the use of those techniques. Such spray techniques have required difficult adjustments and excessive maintenance problems. Further, in electrostatic spraying techniques a relatively thick coating has been required to insure complete coverage of the surface to be coated. Yet further, spraying techniques have been expecially difficult to utilize where the coating of an irregular and/or interior surface has been required.

Inversion flooding has been suggested as a technique for electrocoating of the interior surface of wide mouthed containers. That process is suitable for columnar containers and contemplates inverting the can and inserting upwardly and into the can opening a mating prod with a diameter which closely matches the internal diameter of the can. Electrodeposition coating material is then force-pumped into the can from the top of the prod so as to flood the constricted space between the prod and the can from the top, down along the sides, and out the bottom, thereby to coat the surface. Such a system is limited inherently to coating the interior of containers and, because of the force flooding in the constricted space unless the constrictions are uniform and continous the coating thickness will vary and may be striped.

Accordingly, in view of the shortcomings of the prior art, it is an object of the present invention to provide method and apparatus for electrocoating wherein the problems and disadvantages associated with the prior art may be materially reduced or avoided.

It is a further object of the present invention to provide method and apparatus for electrocoating wherein a work piece may be coated selectively on the interior or exterior surfaces thereof.

It is an additional object of the present invention to provide means for relative movement between an electrically charged work piece and a linear stream of oppositely charged coating, whereby either may be fixed and the other moved in alternative embodiments to permit uniform application of coating onto the entirety of the surface to be coated.

It is a further object of the present invention to provide means for relative motion between an electrically charged work piece having a selected linear dimension and an oppositely charged linear stream of electrophoretic coating material where such relative motion is lateral to such selected linear dimension.

It is a yet further object of the present invention to provide relative rotation between a work piece at a fixed potential, having an axis of symmetry, and a proximately disposed electrode from which flows a charged linear stream of coating material, whereby the entirety of such surface may be electrophoretically coated.

These and other advantages and objects of the present invention will become apparent to those skilled in the art in view of the following specification setting forth in greater detail the preferred embodiments of the present invention.

SUMMARY OF THE INVENTION

The present invention provides an electrophoretic method and apparatus for coating an electrically conductive work piece on either of its interior or exterior surfaces.

In addition to the work piece, the invention contemplates a nozzle for applying coating material, and apparatus for providing relative motion between the work piece and the nozzle. The nozzle provides linear flow corresponding to a selected linear dimension of the work piece surface to be coated, such that upon completion of the cycle of relative movement between the work piece and nozzle in a direction lateral to such selected linear dimension an entire surface of the work piece is coated.

An electrical circuit is provided between the work piece and the nozzle with the work piece being charged to one polarity to serve as one electrode in the electrical circuit. The application nozzle is oppositely charged to serve as the other electrode or, alternatively, an uncharged nozzle may be used, in which case the oppositely charged electrode may be in the form of a conductive mesh disposed between the nozzle and the work piece and proximate thereto.

A liquid electrophoretic coating material is flowed in a linear stream onto the surface of the body to be coated. During such flowing, relative movement between the work piece and the charged linear stream is provided. The relative movement provided may be rotation in some embodiments, such as for example the coating of a cylindrical surface. Excess liquid electrophoretic coating material remaining on the work piece is rinsed therefrom and the coating is then cured.

When the exterior surface of a work piece such as a container is to be coated, the application nozzle and/or electrode used generally conforms to the contours of the exterior surface and the liquid electrophoretic coating material impinges directly thereon. When an interior surface of a work piece is to be coated, an application nozzle and/or electrode is disposed into the work piece in proximate relationship with such interior surface.

Preferably, the temperature of the coating material, its electrical and physical properties, the amount of current applied, the proximity of the electrodes, and the length of coating time should be controlled in order to establish the desired thickness of coating.

The invention will be better understood by reference to the following ensuing description in the specification, drawing and claims.

BRIEF DESCRIPTION OF THE DRAWINGS

FIG. 6 is a schematic elevational view showing apparatus for coating the interior of a work piece including an insulated application nozzle/electrode means for disposing such work piece into electrical circuit relationship with the nozzle/electrode, means for rotating either the container or the nozzle during coating, and a coating reservoir with associated chilling means, filtering means, and pumping means;

FIG. 7 is an enlarged transverse cross-sectional view of a work piece, such as a container, as shown in FIG. 6, and taken along line 7—7 of FIG. 8, with an electrically charged coating nozzle disposed therein, further showing the expansion portion of a nozzle embodiment and an insulating ring for preventing electrical short circuiting of said charged application nozzle;

FIG. 8 is an enlarged longitudinal cross-sectional view of a work piece with an electrically charged coating delivery nozzle disposed in the interior thereof, the particular nozzle having an expansion at the distal end thereof to insure more complete bottom surface coverage, slots or perforations therein for more uniform coating delivery, insulating rings to prevent accidental electrical short circuiting, and insulator means between such nozzle and the reservoir, with arrows indicating the direction of flow of such electrophoretic coating material;

FIG. 9 is an enlarged longitudinal cross-sectional view of another form of nozzle for coating the interior of a work piece, such as an extruded beer can with beaded bottom portion, illustrating a wedge-shaped nozzle for assuring uniform application of coating material to such beads of the container bottom and showing a non-conductive mesh covering for the application nozzle openings to promote laminar flow and to prevent bubbling;

FIG. 10 is an enlarged longitudinal cross-sectional view showing coating of the exterior surface of a rotating work piece by use of a stationary non-charged nozzle having a wedge-shaped top portion and having a separate electrode in the form of a conductive grid or mesh and also showing inside the work piece a schematic view of a vacuum operated work piece holder;

DETAILED DESCRIPTION OF PREFERRED EMBODIMENTS

Figures 1, 2, 3:
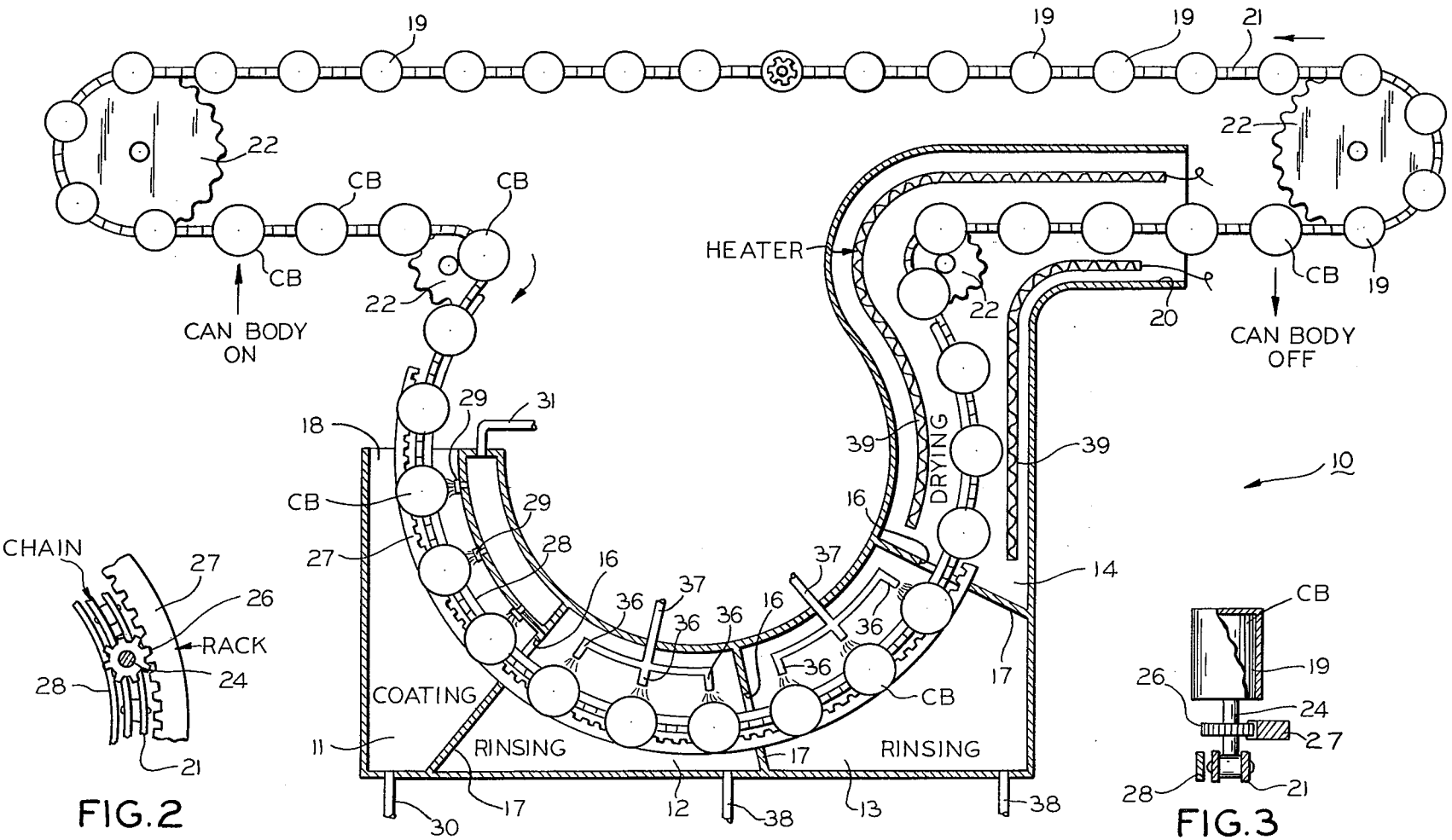
FIG. 1 is a schematic plan view of apparatus used in coating the exterior surface of a work piece, showing an endless conveyor strand reeved about sprockets and carrying work pieces in the form of can bodies thereon through coating, rinsing and curing stations.
FIG. 2 is a slightly enlarged portion of the plan view of FIG. 1 with the can body and work piece holder removed and showing rack and pinion and chain means for rotating work pieces during coating, rinsing and curing of the exterior surface thereof.
FIG. 3 is a slightly enlarged elevational view of the structure for moving the work piece holder means along the endless conveyor strand and for rotation thereof, as shown in FIG. 2.

The method of electrophoretic coating of the present invention is carried out by means of the coating structure set forth generally in FIG. 1 hereof. With specific reference to FIG. 1, the coating apparatus 10 comprises a coating chamber 11 feeding serially into a pair of side-by-side rinsing chambers 12, 13 and a drying chamber 14, such chambers being separated by walls 17 each having openings 16 therein for movement therethrough of a can body CB for coating, rinsing, and curing thereof respectively in such chambers.

Figure 4:
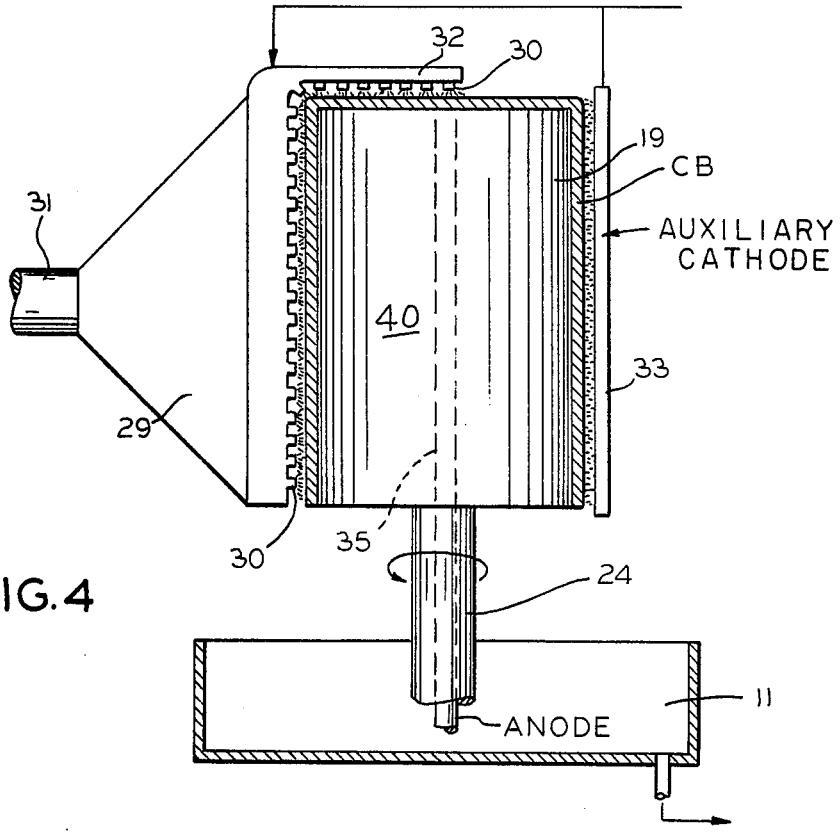
FIG. 4 is an enlarged elevational view of the coating of the exterior surface of a work piece, showing means for disposing the structure into an electrical circuit relationship, including also an application nozzle/electrode, an auxiliary electrode, and means for rotating during coating.

The path of movement of can body CB is along a generally circular path beginning at entrance opening 18 to coating chamber 11 and exiting at opening 20 of drying chamber 14. Such circular movement during processing is provided by means of an endless conveyor strand 21 being reeved preferably about spaced sprockets 22 and a pair of smaller intermediate sprockets 22 disposed respectively near entrance 18 and exit 20. Endless strand 21 may preferably be in the form of a link chain having mandrels 19 disposed in spaced relationship therealong for support and rotation of the can body CB to be coated. An auxiliary electrode as shown in FIG. 4 may be disposed in said coating chamber 11 adjacent such can bodies CB.

Although the conveyor system of FIG. 1 is shown in a horizontal configuration it is understood that other configurations, such as for example a vertical configuration, may be utilized and such modifications are intended to be included with the scope of the present invention.

Referring now to FIGS. 2 and 3, the mandrels 19 are supported upon a rotating shaft 24 having fixed thereon a pinion 26 meshing with a curved rack 27 for providing rotation to such shaft 24 of mandrel 19 and, consequently, to can body CB. Such rotation of can bodies CB occurs by reason of the fact that prior to entering the coating chamber 11, the can bodies CB are placed upon and supported by mandrels 19 about an axial axis of such can bodies. A wear plate 28 may be provided adjacent said endless strand 21 for urging pinion gear 26 into engagement with rack 27. By reason of the movement of endless strand 21 along rack 27 and the meshing of pinion 26 therewith, the can bodies CB supported by such mandrels 19 are caused to rotate and move through the coating chamber 11 and rinsing chambers 12 and 13 while rotating. Although the mandrel rotational speed may be adjusted depending on the physical characteristics of the particular coating material used and the voltage applied, suitable rotational speeds have been found to be in the range of approximately 60–400 R.P.M. This speed of rotation has been found to permit the can body CB to make at least one complete revolution, and possibly to make two such revolutions, during coating application. Such can bodies CB may be placed on mandrels 19 manually or by other apparatus means (not shown). Likewise, apparatus (not shown) may be provided for removing such can bodies CB from mandrels 19 after their exit at opening 20.

Alternatively, a star drive conveyor mechanism of a type well-known in the art may be used for transmitting such work pieces through the coating, rinsing and curing stations.

Figure 5:
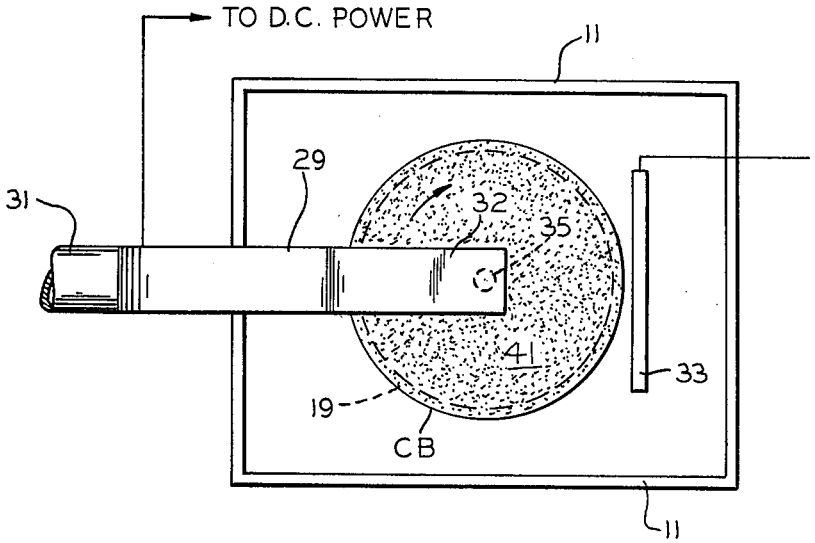
FIG. 5 is a plan view of the structure shown in FIG. 4.

Referring now particularly to FIGS. 4 and 5, which show one embodiment of the coating of an exterior surface by rotating the work piece while moving through coating chamber 11, as set forth hereinabove. A can body CB is rotated by means of mandrel 19 during coating. Liquid electrophoretic coating material is supplied to the exterior surface 40 of such can body CB through application nozzle 29, disposed equidistant said can body CB and is connected to a supply pipe 31 drawing such coating material from a reservoir disposed therebeneath. Such reservoir (not shown) also serves to collect excess coating material flowing from such exterior surface 40 of can body CB to prevent waste thereof.

The supply nozzle 29 may include in an alternative embodiment a supply arm 32 extending over the bottom of exterior surface 40 of inverted can body CB. Where the coating material used is anodic, shaft 24 for turning mandrel 19 is provided with concentric electrically conductive anode means 35 with the nozzle 29 being connected to the cathode side of the anodic-cathodic circuit. (For a cathodic coating material, not shown, the application nozzle would become the anode and the object to be coated would be the cathode). An auxiliary cathode 33 may be provided opposite said supply nozzle 29 to improve the uniformity of the flow and distribution of the electrophoretic coating material. The nozzles 29 are provided with a multiplicity of small openings 30 to improve uniformity of flow distribution of such coating material. The distance between such openings 30 and the exterior surface 40 of such body are preferably in the range of approximately 2 to 15 millimeters.

Rinsing of excess electrophoretic material is provided in rinsing chambers 12 and 13, each of which is supplied from supply pipe 37 connected to nozzle 36, as set forth in FIG. 1. Such excess material may thus be returned to the reservoir. Deionized water is used for such rinsing. In a preferred embodiment, rinse water is supplied as permeate from an ultrafiltration system. The rinse water may be recycled to provide a closed, non-polluting system. Such coated and rinsed can body CB then moves through curing chamber 14 in a path past heater elements 39 provided for curing such rinsed coating. No rotational movement need be provided during curing. When cured, such coated containers may be removed from mandrel 19 by automated means (not shown).

Figure 14:
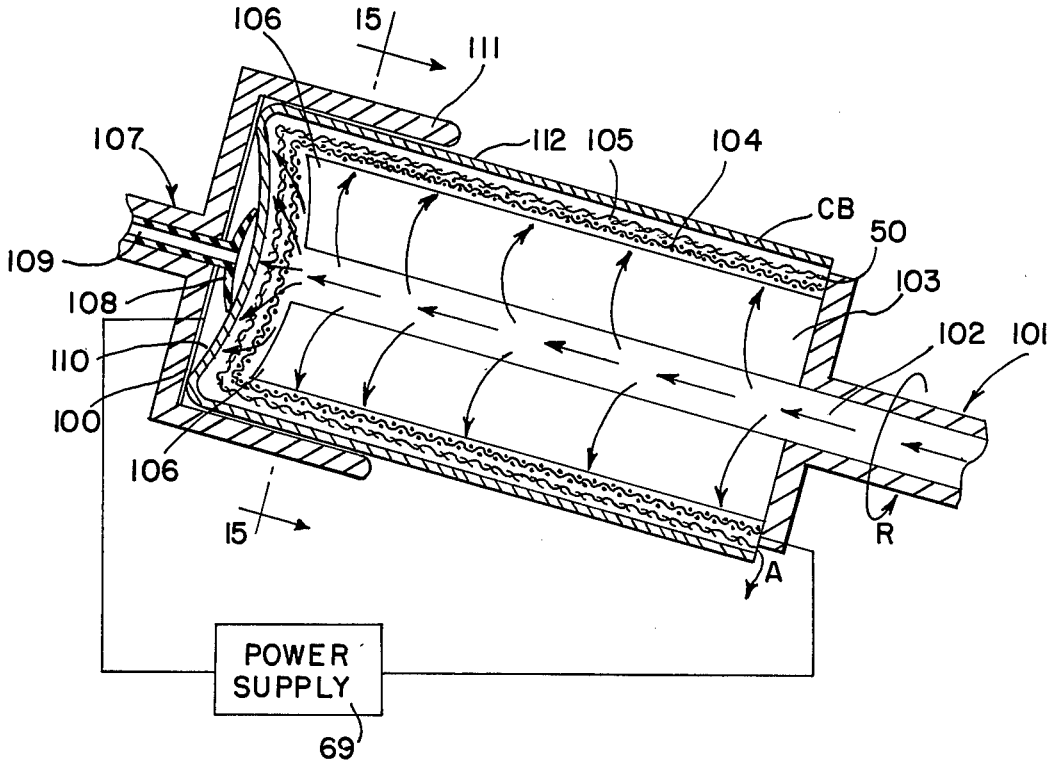
FIG. 14 is an enlarged longitudinal cross-sectional view showing coating of the interior surface of a stationary work piece by a rotating application nozzle and also showing a vacuum operated work piece holder for gripping an exterior surface.

FIGS. 6–9 illustrate method and apparatus for coating the interior surface 50 of a can body or container CB. Such apparatus generally designated as apparatus 49 includes a coating nozzle 51, serving as the electrophoretic coating material delivery tube and also as the cathode in an anodic-cathodic relationship with the container, where anodic coating material is used. Such can body or container CB is supported by and rotationally driven about the axial axis thereof by mandrel means 52 connected to a rotational drive unit (not shown). Alternatively rotational movement may be applied to nozzle 51, with can body CB remaining stationary. Such mandrel means 52 may be connected to the container CB by means of a collar 53 fitting over the bottom exterior surface 54 of such container CB. Alternatively, a vacuum operated work piece holder may be used, as shown in FIG. 14. The power supply 69 utilized typically delivers between approximately 50 and 350 volts. The coating nozzle 51 is insulated from the coating reservoir 56 by means of an insulator 57. Coating material 58 is delivered to the coating nozzle 51 by means of a pump means 59 from coating reservoir 56 into which snorkel means 61 is disposed. After flowing over interior surface 50 of the container CB, excess coating material flows back into reservoir 56. Arrows in FIGS. 6–9 illustrate the path of movement of such coating material 58 from the coating reservoir 56, through snorkel 61, through pre-pump conduit means 62 to pump 59, through post-pump conduit means 63 to nozzle 51, onto the charged interior surface 50 of container CB, with the excess returning to reservoir 56. In a preferred embodiment a chiller 64 and a filter means 65 may be connected to such reservoir 56 for chilling and filtering such coating material.

FIGS. 7, 8 and 9 show in greater detail the shape, disposition, and component parts of coating application nozzle 51. In FIG. 8 for example, such nozzle 51 at a distal end 51*a* thereof has an expansion portion 66 to insure more complete coverage of the interior bottom surface 50A of such container CB. Insulating rings 67 are provided spaced along such nozzle 51 to prevent accidental electrical short circuiting of the cathodic nozzle 51 with the anodic container CB. In general, the application nozzle 51 is adjustably disposed at a distance of approximately two to fifteen millimeters from the container interior surface 50. Disposed at intervals along such application nozzle are slots or perforations 68 for supplemental coating delivery, which slots 68 aid in producing uniformity of the coating.

The embodiment shown in FIG. 9 differs from that of FIG. 8 in the shape of nozzle 51, which is wedge-shaped to provide uniform application of coating material 58 into beads 60 at the bottom of can body CB, which may be for example an extruded beer can. Also provided is a non-conductive mesh 67*a* covering openings 68 of nozzle 51 to insulate nozzle 51 from can body CB, to promote laminar flow, and to prevent bubbling of the coating material. Preferably, the application nozzle 51 is adjustably disposed at a distance of approximately two to fifteen millimeters from the container interior surface 50. Apparatus in accordance with the present invention should preferably have the open end thereof tilted slightly downwardly from the horizontal to permit excess coating material to flow back into the bath as illustrated by arrow A in FIG. 9.

The apparatus set forth in FIGS. 6–9 for coating the interior surface 50 of a rotating container CB by a stationary nozzle 51 may be utilized with an endless chain driving means in conjunction with the rack and pinion drive for coating an exterior surface as set forth in FIG. 1, and the principles set forth therein are equally applicable to such apparatus for coating interior surfaces.

Figure 11:
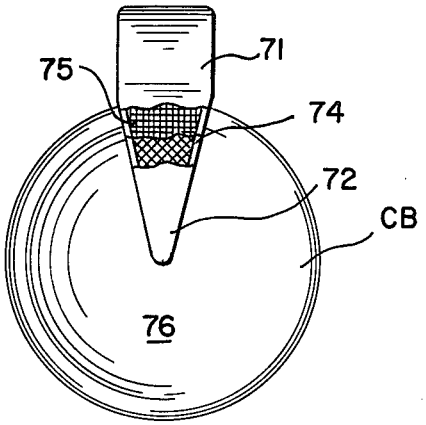
FIG. 11 is an end view taken along line 11—11 of FIG. 10.

Referring now to FIGS. 10 and 11, the coating of the exterior surface 70 of a rotating work piece CB by means of a stationary nozzle 71 similar in principle to that shown in FIGS. 4 and 5 is shown. The stationary and uncharged nozzle 71 has a wedge-shaped top portion 72 which is contoured to correspond to the contours of exterior surface 70 of the work piece CB, which may be a beer can as shown. The nozzle 71 contains coating openings 73 adjacent work piece CB for flowing a uniform coating over such work piece CB as shown by arrows. A similarly shaped electrode grid 74 is disposed intermediate said nozzle 71 and the work piece CB to provide electrical current to the electrocoating material as it flows from nozzle 71 onto workpiece CB. A non-conductive mesh 75 covers grid 74 for preventing accidental short circuiting between work piece CB and grid 74 and also to promote laminar flow and to reduce bubbling. Grid 74 has a wedge-shaped portion disposed proximate to the exterior surface of the closed end of the container CB being coated and serves to insure the same dwell coating time for any point on the closed end of exterior surface 76 of work piece CB for a given rotation, to permit uniform electrocoating thereof. FIG. 10 also schematically shows can holder means generally designated as 78. A vacuum cup 80 engages the interior bottom surface 81 of the work piece CB and is supplied with vacuum by means of a vacuum line 82. The can holder means 78 also holds the work piece CB in place by means of spring 83 abutting against interior side surface 84 and is supported on either side by spring supports 85, 85 connected to and projecting from vacuum line 82.

Power supply 69 is shown connected to grid 74 and to work piece CB through its conductive connection with a slip ring 86 having brushes 87 abutting on vacuum line 82 to provide electrical current thereto through electrically conductive spring supports 85, 85 and spring 83. Electrical current is then applied to work piece CB through its contact with spring 83. As indicated by arrow R, vacuum line 82 provides rotation to the work piece CB by rotation means (not shown).

Figure 13:
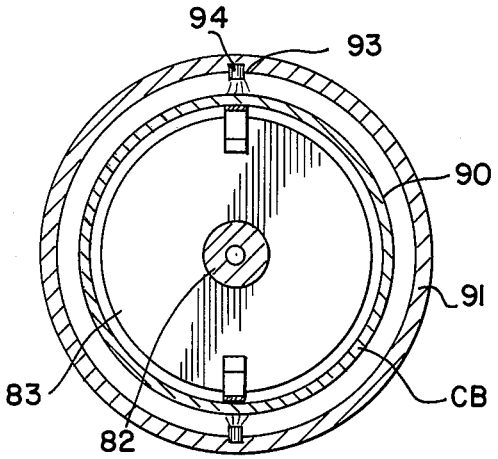
FIG. 13 is a transverse cross-sectional view taken along line 13—13 of FIG. 12.
Figure 12:
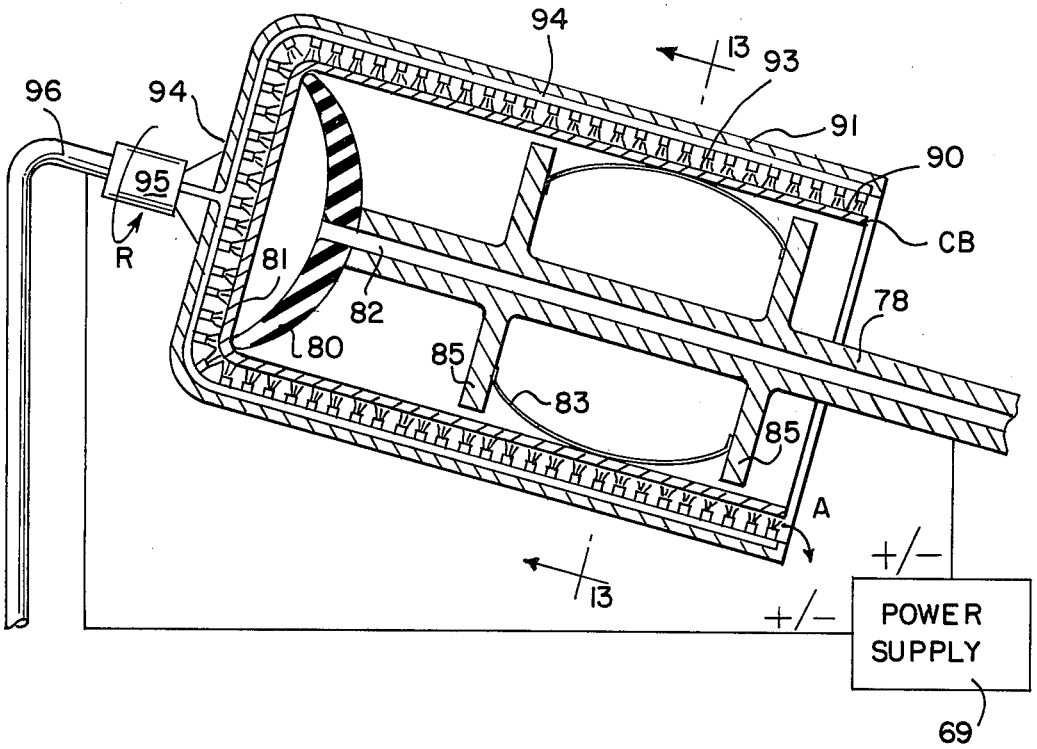
FIG. 12 is an enlarged longitudinal cross-sectional view showing coating of the exterior surface of a stationary work piece by means of a rotating application nozzle.

FIGS. 12 and 13 illustrate apparatus for coating the exterior surface 90 of a stationary work piece CB by rotating an electrically charged application nozzle/electrode 91. Nozzle 91 may completely enclose the portion of work piece CB to be coated, such that, during rotation, the coating material flowed over surface 90 will be centrifugally urged against such exterior surface 90 and not be wasted. After coating, the excess coating drains back into the bath as illustrated by arrow A.

Flow openings 93 are provided in nozzle 91 from coating channels 94 therein. Although openings 93 only need be provided over one side and one-half of the bottom of nozzle 72, a symmetrical arrangement such as shown in FIG. 13 is preferred for balance during rotation.

Coupling 95, which transmits coating material to nozzle 91, is rotationally disposed on electrically charged coating supply tube 96. Rotational means (not shown) are connected to coupling 95 and provide rotation thereto and to nozzle 91 thereby as illustrated by arrow R. Power supply in the form of a rectifier 69 provides electrical current to nozzle 91 and also to work piece CB through vacuum line 82 of work piece holder 78. The details of work piece holder 78 and the electrical connection provided thereby are similar to those described hereinabove in connection with FIG. 10.

As also disclosed hereinabove, the particular direction of the current applied depends upon whether anodic or cathodic coating is to be used. After rotational coating, nozzle 91 and work piece CB may be separated by removal of either, such as for example by reciprocating movement.

Figure 15:
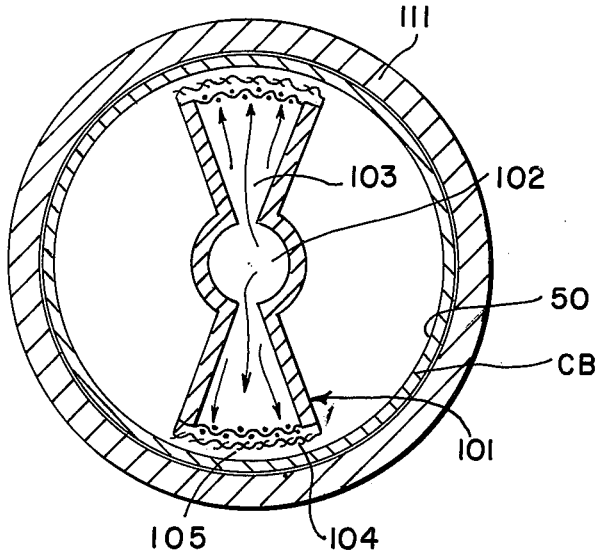
FIG. 15 is a transverse cross-sectional view taken along line 15—15 of FIG. 14.

FIGS. 14 and 15 illustrate embodiments of the present invention for coating the interior surface 50 of a stationary work piece CB by means of a rotating application nozzle/electrode. Rotating application nozzle/electrode, generally designated as 101, comprises an interior coating tube 102 opening into one or more coating channels 103, 103. As shown by arrows, coating material flows through grid 104, which is connected to power supply 69 to also serve as an electrode. Preferably, a non-conductive mesh 105 covers grid 104 to prevent accidental contact between nozzle 101 and work piece CB. As with the embodiment shown in FIG. 9, nozzle 101 may have wedge-shaped terminal portions 106, 106 to match more closely the contours of a beaded bottom can, such as a beer can, for uniformity of electrocoating deposition.

FIGS. 14 and 15 also depict schematically the structure of an electrically conductive can holder generally designated as 107. A vacuum cup 108, supplied by a vacuum line 109 engages a portion of the bottom exterior surface 110 of work piece CB to hold it securely. A non-conductive collar 111 concentrically disposed with respect to the vacuum line 109 engages a portion of the exterior wall surface 112 of the work piece CB to supplement the support provided by vacuum cup 108. An electrically conductive bottom plate 100 is disposed within holder 107 to provide electrical current to the work piece CB.

Figure 16:
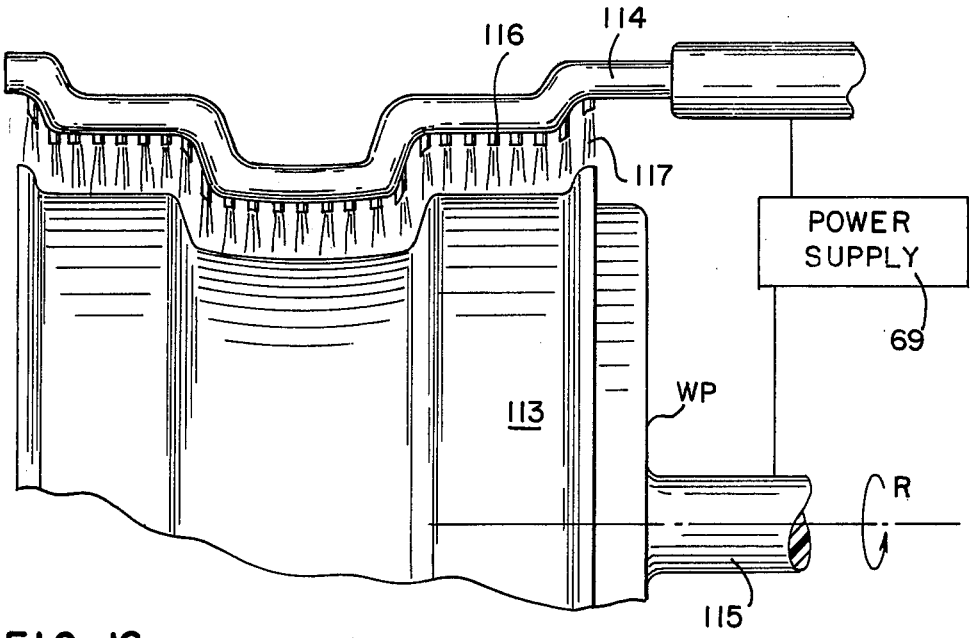
FIG. 16 is an enlarged schematic elevational view showing coating of the exterior surface of a contoured work piece, such as an automobile wheel, by means of a stationary application nozzle and/or electrode having a surface matching the contours of the work piece, and means for rotating such work piece, whereby uniform application of coating material may be achieved.

FIG. 16 shows the electrophoretic coating of a work piece WP having a surface 113 having an axis of symmetry, such as for example an automobile wheel. Electrical current is applied in one polarity from power supply rectifier 69 to application nozzle and/or electrode 114 and in the opposite polarity to a conductive work piece holder 115 and thereby to work piece WP. Nozzle 114 is disposed to be co-extensive with the longitudinal linear dimension of surface 113 and is shaped to conform to any contours in surface 113 of work piece WP, such that each nozzle opening 116 is proximate to and substantially equidistant from surface 113 for uniformity of application of coating material.

Nozzle 114 may alternatively be made of a flexible conductive material to be adjustable for various different contoured surfaces and can preferably be readily adjusted for a different such contoured surface merely by first pressing it firmly against the surface to be coated and then disposing the matching nozzle a selected, proximate distance from the surface.

A linear stream 117 of electrophoretic coating is applied to surface 113 co-extensive with the longitudinal linear dimension thereof and relative movement is provided between the linear stream 117 and the work piece surface. Such relative motion is lateral to the linear dimension and circumferential to and about the axis of symmetry of the work piece surface 113. Although such relative movement may be accomplished by moving either the work piece WP or the linear stream 117, in the example shown in FIG. 16 work piece WP is rotated by means of a holder 115, which may also serve as a reciprocator connecting means for separating the work piece from the application nozzle after coating. Alternatively, nozzle 114 may be mounted for reciprocating movement by means not shown.

Although the selected linear dimension of the work piece is illustrated as being rectilinear in FIGS. 1–9 and 11–15 and partially rectilinear in other embodiments illustrated herein, it is within the contemplation of the present invention that such selected linear dimension may also be partially or totally curvilinear. For example, where the selected linear dimension of the work piece is curvilinear such as for example in cylindrical tubing, the nozzle for flowing the coating could be disposed annularly or semi-annularly with respect to the surface to be coated and either the nozzle or the work piece moved axially (laterally) with respect to the circumferential (linear) dimension for coating the entirety of the surface.

In the above described preferred embodiments the distance between the anode and cathode can vary between 2 and 15 millimeters with a preferred separation of 4 to 5 millimeters. The speed of rotation of the work piece or the electrode may range from 60 R.P.M. to 400 R.P.M.; however, the preferred range is 120 to 240 R.P.M.

The flow of coating can vary from one quart to 5 gallons per minute per application nozzle. There is no absolute optimum as the flow rate must be determined for each specific work piece to be coated and will vary with the size and shape thereof.

The coating voltage can range from 50 to 350 volts. However, the preferred voltage will vary with the size and shape of the work piece and the formulation of the coating. However, 150 to 180 volts is generally satisfactory.

Coating temperature can range from 60° to 140° F., but the most practical range is 70° to 90° F. The viscosity of the coating is not critical, but is most usually close to that of water. The percent solids of the coating can be varied between 7 and 15%, but the preferred operating range is approximately 12%.

Coating time will vary considerably depending upon voltage, paint temperature, type of substrate, and film thickness desired; however, it is desirable to keep the coating time as low as possible. Practical operating ranges will vary from 0.1 second to 10 seconds, with coating times of between 0.3 second and 3 seconds, usually being the most practical.

A typical example of apparatus in accordance with the present invention for coating the interior of aluminum containers, as shown in FIGS. 6–9, would be designed to coat 300 cans per minute using a coating time of 0.5 seconds and a voltage of 180 volts. The paint temperature would be 80° – 90° F. and the percent solids of the paint would be 12% to 14%. The speed of rotation of the can would be 240 R.P.M. and the flow rate of the paint would be ¾ths of a gallon per munute per application nozzle. Distance from the electrode to the container would be 4 millimeters. Following the coating process, the can would be rinsed to remove excess coating material and baked in an oven at any desired temperature to effect satisfactory cure of the coating.

The basic and novel characteristics of the electrophoretic coating method and apparatus of the present invention and the attending advantages thereof will be readily understood from the foregoing disclosure by those skilled in the art and it will become readily apparent therefrom that various changes and modifications may be made in the form, construction and arrangement of the method and apparatus set forth hereinabove without departing from the spirit and scope of the invention. Accordingly, the preferred embodiments of the present invention set forth hereinabove are not intended to limit such spirit and scope in any way.

What is claimed is:

1. A method for electrophoretically coating a surface of an electrically conductive work piece having a selected linear dimension, comprising the steps of:

establishing said work piece at one electrical polarity, flowing an electrophoretic coating material in a linear stream along the selected linear dimension of the work piece, inducing an electrical charge of opposite polarity on the electrophoretic material and along the length of the linear stream thereof, whereby electrophoretic migration of the electrophoretic material to the work piece is effected, and moving the work piece and the charged linear stream of electrophoretic material relative to one another about an axis fixed relative to the linear stream and in a direction lateral to the linear dimension, thereby to electrophoretically deposit a coating of the material over the entirety of the surface of the work piece.

2. The method set forth in claim 1 comprising the further steps of:

rinsing excess electrophoretic material from the coating on the work piece, and curing the remaining electrophoretic material on the coated work piece.

3. The method set forth in claim 1 wherein the work piece is moved relative to the linear stream of electrophoretic material.

4. The method set forth in claim 1 wherein the linear stream of electrophoretic material is moved relative to the work piece.

5. The method set forth in claim 1 wherein:

the work piece has an axis of symmetry, the linear stream of electrophoretic material is coextensive with a linear dimension of a surface of said work piece, and said relative movement is about the axis of symmetry of the work piece.

6. The method set forth in claim 5 wherein:

the work piece is a cylindrical body, the axis of symmetry is the longitudinal axis of the cylindrical body, and the selected dimension is the length of the cylindrical body.

7. The method set forth in claim 6 wherein:

the cylindrical body is closed at one end, and the linear stream of electrophoretic material is flowed along a radius of the closed end as well as along the length of the cylindrical body.

8. The method set forth in claim 6 comprising the further steps of:

rinsing excess electrophoretic material from the coating on the work piece, and curing the remaining electrophoretic material on the work piece.

9. The method set forth in claim 6 wherein the surface of the work piece is the exterior surface.

10. The method set forth in claim 6 wherein the surface of the work piece is the interior surface.

11. An apparatus for electrophoretically coating a surface of an electrically conductive work piece having a selected linear dimension, said apparatus comprising:

a reservoir for containing a liquid electrophoretic material;

means for mounting the work piece to display the selected linear dimension thereof;

a nozzle disposed in close proximity to the surface of the work piece along the selected linear dimension;

a pump for pumping the electrophoretic material from said reservior through said nozzle thereby to provide a linear stream of electrophoretic material onto the surface of the work piece;

means for charging the work piece and said nozzle with opposite electrical charges to effect migration of electrophoretic material between said nozzle and the work piece;

means for moving the work piece and said nozzle relative to one another about a axis fixed relative to the work piece and said nozzle and in a direction lateral to the selected linear dimension of the work piece, whereby the entire surface of the work piece is covered by the linear stream of electrophoretic material, thereby to coat the surface; and means for returning the excess electrophoretic material flowing from the linear stream to said reservoir.

12. The electrophoretic coating apparatus of claim 11 further comprising:

means for rinsing excess electrophoretic material from the work piece.

13. The electrophoretic coating apparatus of claim 12 further comprising:

means for curing the coating of electrophoretic material on the work piece.

14. The electrophoretic coating apparatus of claim 11 wherein:

said nozzle includes an electrically conductive grid disposed on said nozzle proximate the outlet therein.

15. The electrophoretic coating apparatus of claim 14 wherein:

the work piece is a cylindrical body, and the fixed axis is coincident with the longitudinal axis of the cylindrical body and the selected linear dimension is the length of the cylindrical body.

16. The electrophoretic coating apparatus of claim 15, wherein the cylindrical body is closed at one end and open at one end, wherein said nozzle is disposed in close proximity to the closed end and to the center thereof, and wherein the linear stream extends along a radius of the closed end as well as along the length of the cylindrical body and flows from the open end of the cylindrical body.

17. The electrophoretic coating apparatus of claim 16 wherein said nozzle and the work piece are spaced apart along the linear dimension by a distance not greater than the thickness of the linear stream thereby to establish a path for electrophoretic migration of the electrophoretic material between said nozzle and the work piece along the entire length of the linear dimension.

* * * * *